US010955180B2

(12) United States Patent
Sim et al.

(10) Patent No.: US 10,955,180 B2
(45) Date of Patent: Mar. 23, 2021

(54) ICEMAKER

(71) Applicant: COWAY CO., LTD., Chungcheongnam-do (KR)

(72) Inventors: Sang-Gu Sim, Seoul (KR); Myung-Jin Park, Seoul (KR); Jung-Chul Park, Seoul (KR); Hyun-Woo Lee, Seoul (KR); Sung-Jin Kim, Seoul (KR); In-Du Choi, Seoul (KR)

(73) Assignee: Coway Co., Ltd

( * ) Notice: Subject to any disclaimer, the term of this patent is extended or adjusted under 35 U.S.C. 154(b) by 70 days.

(21) Appl. No.: 16/331,347

(22) PCT Filed: Sep. 8, 2017

(86) PCT No.: PCT/KR2017/009871
§ 371 (c)(1),
(2) Date: Mar. 7, 2019

(87) PCT Pub. No.: WO2018/048242
PCT Pub. Date: Mar. 15, 2018

(65) Prior Publication Data

US 2019/0360735 A1 Nov. 28, 2019

(30) Foreign Application Priority Data

Sep. 8, 2016 (KR) ..... 10-2016-0115666
Jun. 15, 2017 (KR) ..... 10-2017-0075891

(51) Int. Cl.
*F25C 1/10* (2006.01)
*F25C 1/147* (2018.01)
(Continued)

(52) U.S. Cl.
CPC ..... *F25C 1/10* (2013.01); *F25C 1/147* (2013.01); *F25C 5/04* (2013.01); *F25C 5/18* (2013.01); *F25C 2300/00* (2013.01)

(58) Field of Classification Search
CPC .... F25C 1/10; F25C 1/147; F25C 1/00; F25C 1/12; F25C 1/14; F25C 5/04; F25C 5/18;
(Continued)

(56) References Cited

U.S. PATENT DOCUMENTS 2,706,385 A 4/1955 Topping
3,196,625 A * 7/1965 Nicolaus ..... F25C 1/00 62/71
(Continued)

FOREIGN PATENT DOCUMENTS

JP 63-125762 8/1988
JP 6117740 4/1994
(Continued)

OTHER PUBLICATIONS

PCT/ISA/210 Search Report issued on PCT/KR2017/009871 pp. 5.
(Continued)

*Primary Examiner* — Emmanuel E Duke
(74) *Attorney, Agent, or Firm* — The Farrell Law Firm, P.C.

(57) ABSTRACT

An icemaker according to present invention may comprise: a device body having an inflow penetration portion and a discharge penetration portion formed therein; a flow portion having an inflow opening and a discharge opening provided to penetrate the inflow penetration portion and the discharge penetration directly or indirectly, respectively, and having a flow space formed therein so as to connect with the inflow opening and the discharge opening; a cooling portion configured such that a refrigerant flows to at least a part of the periphery of the flow portion, thereby cooling water, which is introduced into the flow space through the inflow opening and flows therein, and turning the same into ice or cold water; and a separating/transferring portion for separating the ice, which has been generated in the flow space, from the
(Continued)

flow space and transferring the same to the discharge opening.

11 Claims, 18 Drawing Sheets

(51) Int. Cl.
*F25C 5/04* (2006.01)
*F25C 5/18* (2018.01)

(58) Field of Classification Search
CPC ..... F25C 2300/00; F25C 1/145; F25C 5/182; F25C 2400/14; F25C 2400/10; F25D 31/002
See application file for complete search history.

(56) References Cited

U.S. PATENT DOCUMENTS

| | | | | |
|---|---|---|---|---|
| 3,650,121 | A * | 3/1972 | Kimpel | F25C 1/147 62/136 |
| 6,367,285 | B1 | 4/2002 | Shinozaki et al. | |
| 2006/0277937 | A1 | 12/2006 | Schlosser et al. | |
| 2016/0003515 | A1 | 1/2016 | Brunner et al. | |

FOREIGN PATENT DOCUMENTS

| | | |
|---|---|---|
| JP | 2006308129 | 11/2006 |
| KR | 1020140126988 | 11/2014 |
| KR | 1020150004736 | 1/2015 |
| KR | 101488913 | 2/2015 |
| KR | 1020150019117 | 2/2015 |
| WO | WO 98/56480 | 12/1998 |

OTHER PUBLICATIONS

PCT/ISA/237 Written Opinion issued on PCT/KR2017/009871 pp. 9.

Japanese Office Action dated Feb. 26, 2020 issued in counterpart application No. 2019-513305, 5 pages.

European Search Report dated Jul. 4, 2019 issued in counterpart application No. 17849126.2-1009, 8 pages.

* cited by examiner

ICEMAKER

PRIORITY

This application is a National Phase Entry of International Application No. PCT/KR2017/009871, which was filed on Sep. 8, 2017, and claims priority to Korean Patent Application Nos. 10-2016-0115666 and 10-2017-0075891, which were filed on Sep. 8, 2016 and Jun. 15, 2017, respectively, the content of each of which is incorporated herein by reference.

TECHNICAL FIELD

The present disclosure relates to an icemaker for making ice.

BACKGROUND ART

An icemaker makes ice.

As an icemaker, an immersion-type icemaker in which an immersed member connected to an evaporator in which a refrigerant flows is immersed in water in a water tray, such that ice is formed on the immersed member has been used. Also, there is a spraying type icemaker including an evaporator in which a refrigerant flows, and making ice in an ice making portion by spraying water onto the ice making portion on an ice tray on which the ice making portion is provided. A flow type icemaker has also been used, which includes an evaporator in which a refrigerant flows, and makes ice in an ice making portion by flowing water to the ice making portion on an ice tray on which the ice making portion is provided.

Also, there is an auger type icemaker in which ice is made on an inner circumferential surface of a flow space by flowing a refrigerant to the periphery of the flow space in which water flows and rotating a screw member in the flow space such that the ice is isolated from the inner circumferential surface of the flow space and is transferred and discharged externally.

The auger type icemaker, however, may only make ice, and may not make cold water.

DISCLOSURE

Technical Problem

An aspect of the present disclosure is to address at least one of the above demands or issues occurring in the related art.

An aspect of the present disclosure is to provide an icemaker capable of making ice and also making cold water.

Another aspect of the present disclosure is to provide an icemaker having improved cooling ability.

Technical Solution

According to an aspect of the present disclosure, an icemaker according to an exemplary embodiment includes features as outlined below.

According to an aspect of the present disclosure, an icemaker includes a device body including an inflow penetration portion and a discharge penetration portion; a flow portion including an inflow opening and a discharge opening, directly or indirectly penetrating through the inflow penetration portion and the discharge penetration portion, respectively, and including a flow space connected to the inflow opening and the discharge opening; a cooling portion allowing a refrigerant to flow in at least a portion of a periphery of the flow portion such that water entering the flow space through the inflow opening and flowing in the flow space is cooled to be turned into ice or cold water; a separating and transferring portion separating ice made in the flow space from the flow space and transferring the ice to the discharge opening; and a supplying and storing portion connected to the inflow opening and the discharge opening to supply water to the inflow opening and to receive ice or cold water from the discharge opening.

The separating and transferring portion may include a screw member rotatably provided in the flow space, and the supplying and storing portion may include a pump connected to the inflow opening.

The screw member may be driven to discharge ice from the discharge opening and to supply ice to the supplying and storing portion, or the pump may be driven to discharge cold water from the discharge opening and to supply the cold water to the supplying and storing portion.

The supplying and storing portion may further include a supplying and storing member having an ice storing space storing ice and a water storing space storing water.

The supplying and storing portion may include a supplying and connecting port connected to the water storing space and the pump.

The supplying and storing portion may further include a supplying and storing pipe having one side directly or indirectly connected to the discharge opening, and allowing ice discharged from the discharge opening to be supplied to and stored in the ice storing space or allowing cold water discharged from the discharge opening to be supplied to and stored in the water storing space.

The supplying and storing portion may further include a dividing member dividing a storage space formed in the supplying and storing member into the ice storing space and the water storing space.

The other side of the supplying and storing pipe may penetrate through the supplying and storing member and may be disposed in the water storing space.

The supplying and storing pipe may include a supply hole formed on the other end of the supplying and storing pipe, the supply hole through which ice or cold water is discharged and which is formed towards the ice storing space. A lower end of the supply hole may be positioned lower than an upper end of the dividing member, and an upper end of the supply hole may be positioned higher than the upper end of the dividing member.

The supplying and storing pipe may have a supply hole on the other end of the supplying and storing pipe, the supply hole through which ice or cold water is discharged and which is formed towards the ice storing space, and the supplying and storing pipe may further include a supply guiding member connected to the other end of the supplying and storing pipe and guiding ice or cold water discharged from the supply hole to be supplied to the ice storing space or the water storing space, respectively.

The supply guiding member may include an ice guiding hole connected to the supply hole and formed towards the ice storing space, and a lower end of the ice guiding hole may be positioned higher than a lower end of the supply hole.

The supply guiding member may include an extended guiding portion extending from a lower end of the ice guiding hole to the ice storing space and guiding ice discharged from the ice guiding hole to be supplied to the ice storing space.

The supplying and storing portion may further include a foreign object removing member through which foreign objects are removed from cold water as water passes through the foreign object removing member, and the cold water may flow into the water storing space.

The foreign object removing member may include a mesh member filtering foreign objects included in cold water.

The foreign object removing member may be separably connected to the supplying and storing pipe or the supply guiding member connected to the supplying and storing pipe.

The flow portion may include an inflow member including the inflow opening; a flow member connected to the inflow member and having the flow space; and a discharge member connected to the flow member and including the discharge opening.

The flow portion may further include an extended discharge member connected to the discharge opening, and the discharge penetration portion may be connected to the supplying and storing pipe included in the supplying and storing portion and connected to the extended discharge member.

The cooling portion may include a refrigerant space forming member provided to surround at least a portion of the flow portion such that a refrigerant flowing space in which a refrigerant flows may be formed between the cooling portion and the flow portion, and a refrigerant inflow opening and a refrigerant outflow opening may be connected to the refrigerant space forming member.

Advantageous Effects

As set forth above, according to an exemplary embodiment in the present disclosure, water flowing in a flow space formed in a flow portion included in an icemaker may be cooled by a refrigerant flowing in at least a portion of the periphery of the flow portion, thereby making ice or cold water.

Also, according to an exemplary embodiment in the present disclosure, the icemaker may make cold water as well as ice.

Further, according to an exemplary embodiment in the present disclosure, an icemaker may have improved cooling ability.

DESCRIPTION OF DRAWINGS

FIG. 6 illustrates an example in which a refrigerant flows in a cooling portion of an icemaker, FIGS. 7 to 9 illustrate an example in which an ice making operation is performed in an icemaker, and FIGS. 10 to 12 illustrate an example in which a cold water making operation is performed in an icemaker, according to an exemplary embodiment in the present disclosure;

MODE FOR INVENTION

Figure 1:
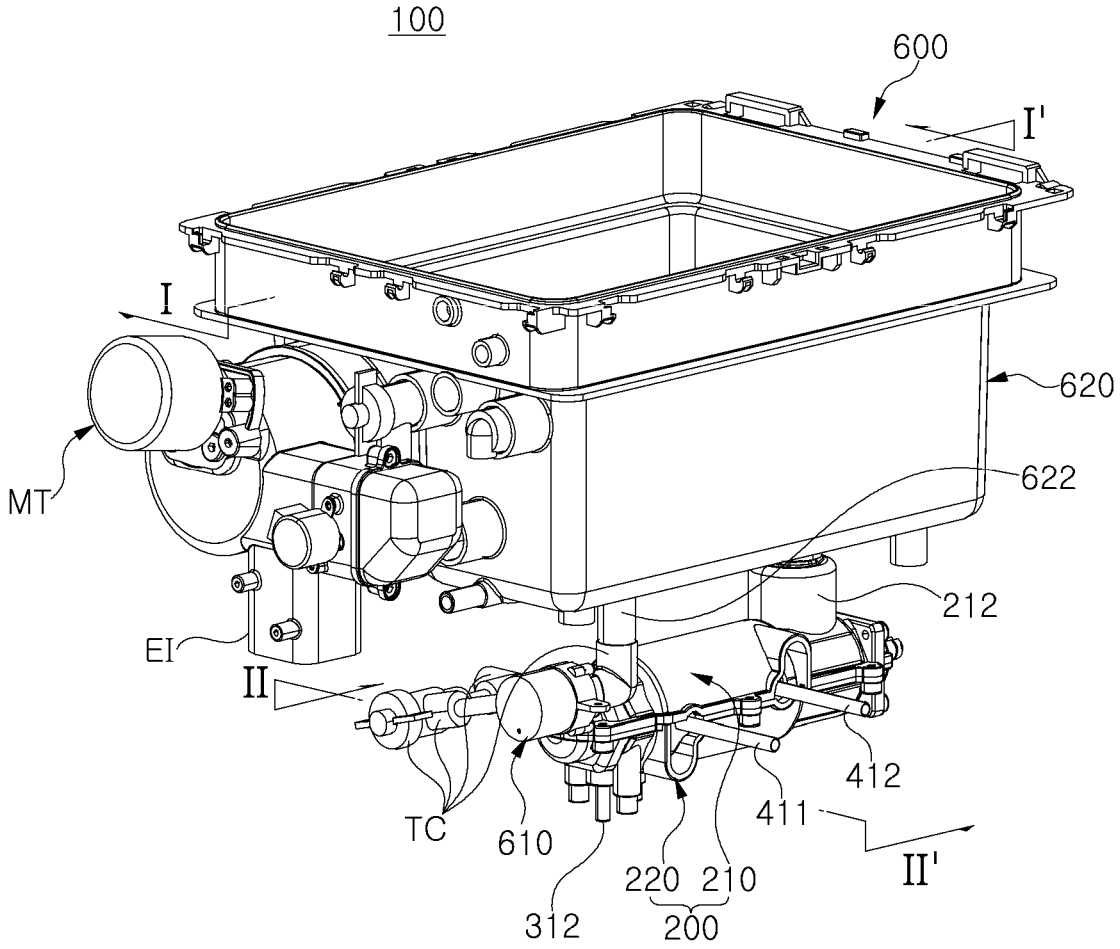
FIG. 1 is a perspective diagram illustrating an icemaker according to an exemplary embodiment in the present disclosure.

To help understanding of features of the present invention as above, exemplary embodiments of an icemaker will be described in greater detail.

In the descriptions below, the present disclosure will be described based on the most appropriate exemplary embodiments for an understanding of technical features in the present disclosure. It is to be understood that the technical features of the present invention are not limited to the exemplary embodiments, and the present invention may be implemented as in the exemplary embodiments described herein. Thus, the present invention may be modified in various manners through the exemplary embodiments described herein within the technical scope of the present invention, and the modified exemplary embodiments are to be included in the technical scope of the present invention. Also, to help in an understanding of the exemplary embodiments, as for reference numerals in the attached drawings, relevant elements among elements having the same function in the exemplary embodiments are indicated by the same or similar forms of reference numeral.

In the descriptions below, an icemaker will be described with reference to FIGS. 1 to 18 according to exemplary embodiments.

Figure 2:
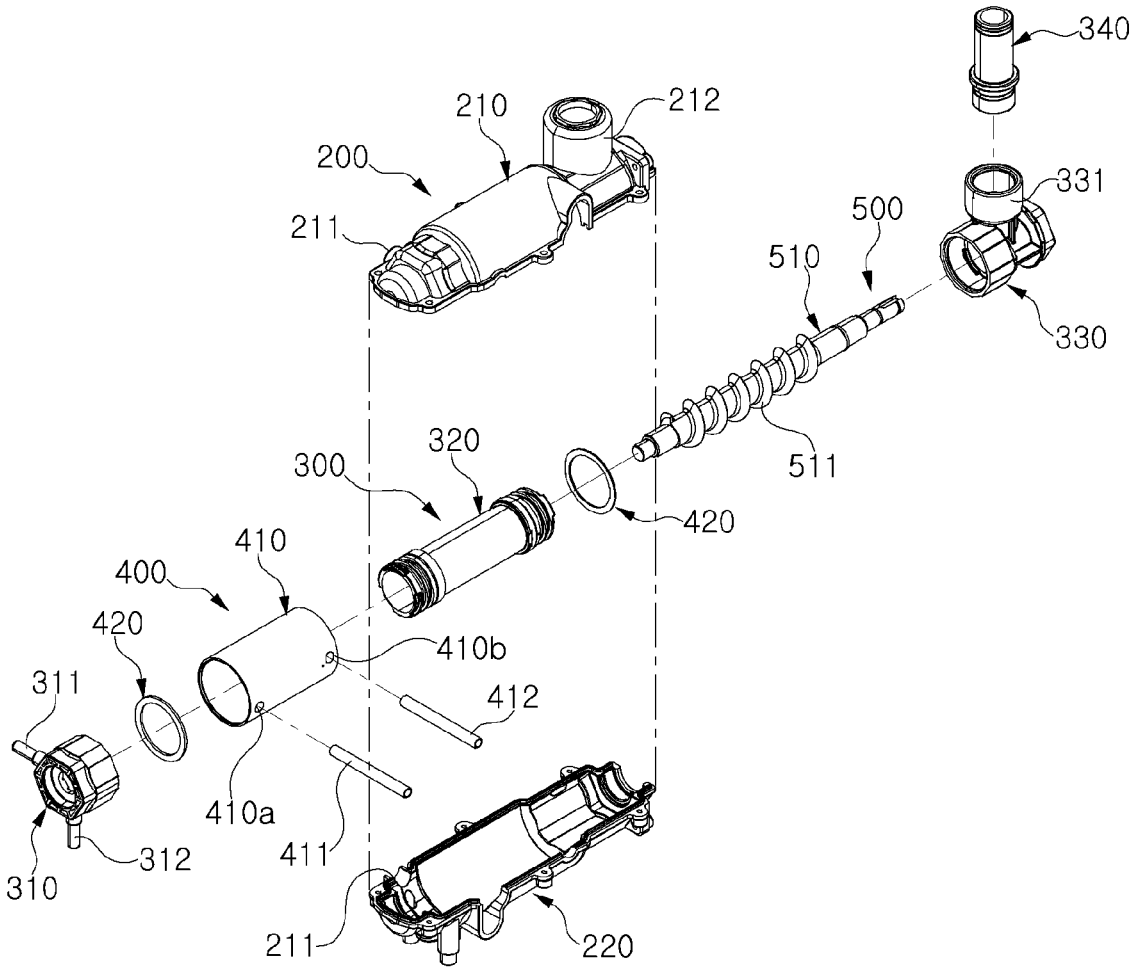
FIG. 2 is an exploded perspective diagram illustrating a device body, a flow portion, a cooling portion, and an separating and transferring portion of an icemaker according to an exemplary embodiment in the present disclosure.
Figure 3:
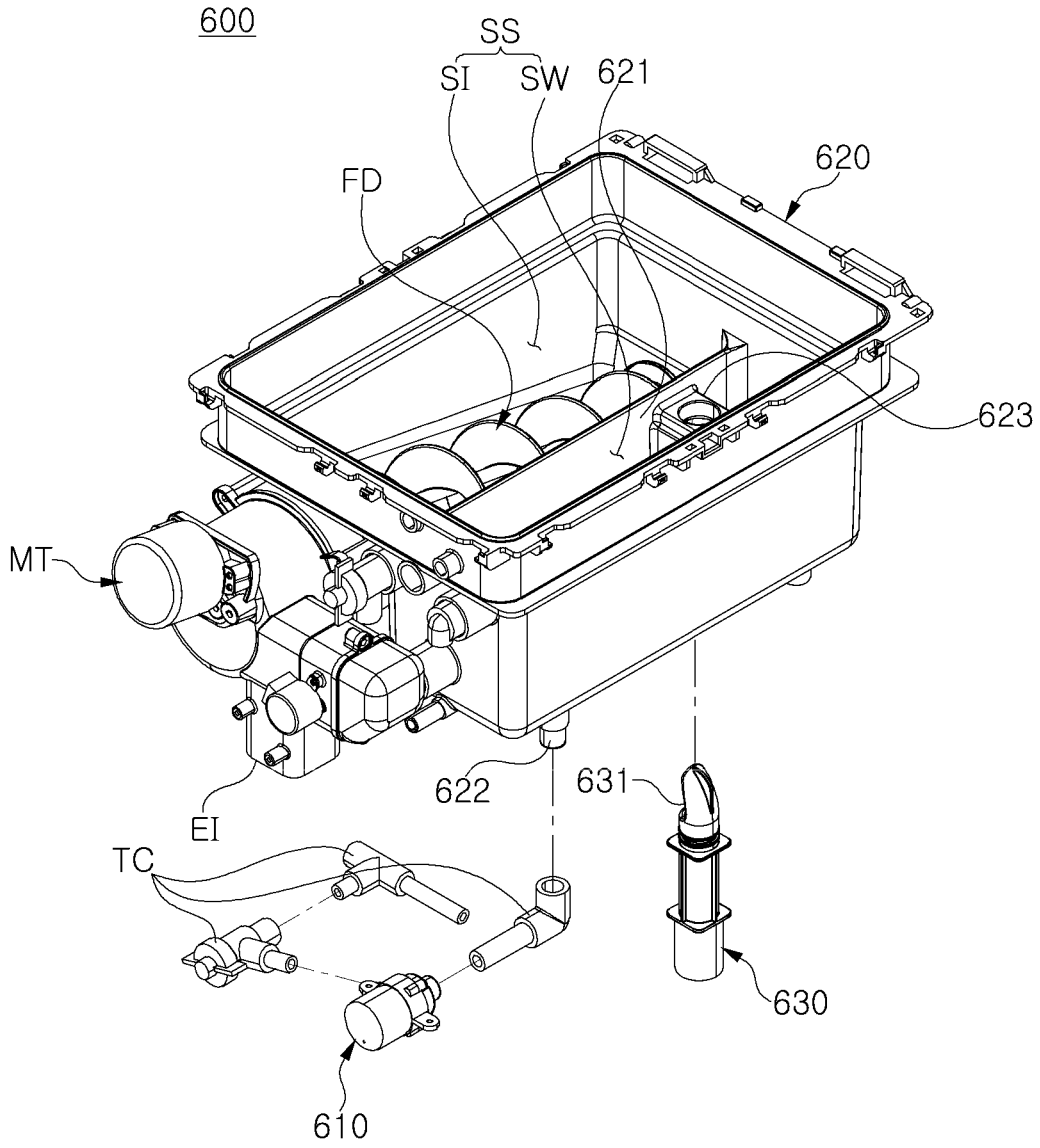
FIG. 3 is an exploded perspective diagram illustrating a supplying and storing portion of an icemaker according to an exemplary embodiment in the present disclosure.

FIG. 1 is a perspective diagram illustrating an icemaker according to an exemplary embodiment. FIG. 2 is an exploded perspective diagram illustrating a device body, a flow portion, a cooling portion, and a separating and transferring portion of an icemaker according to an exemplary embodiment. FIG. 3 is an exploded perspective diagram illustrating a supplying and storing portion of an icemaker according to an exemplary embodiment.

Figure 4:
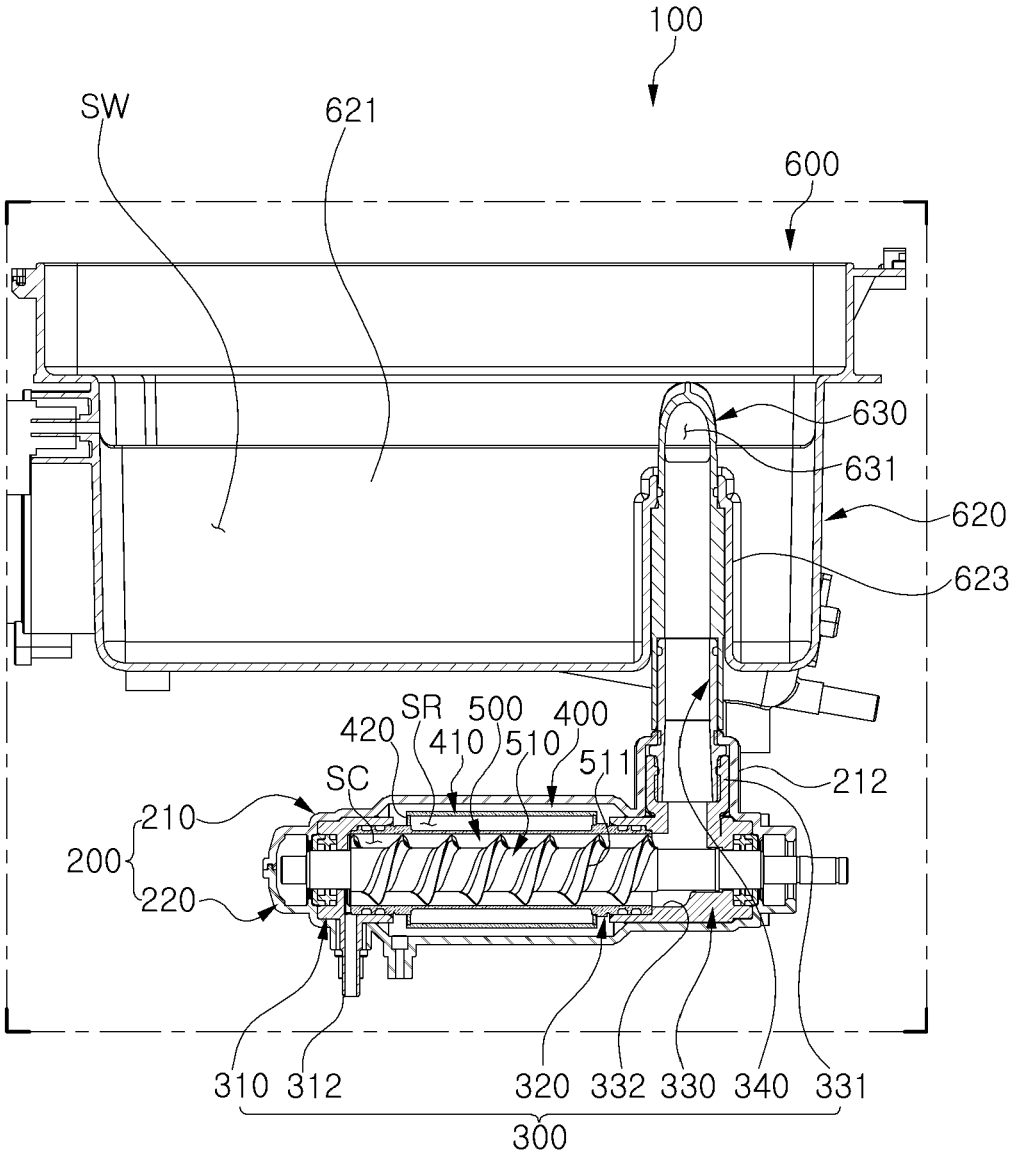
FIG. 4 is a cross-sectional diagram taken along line I-I' in FIG. 1.
Figure 5:
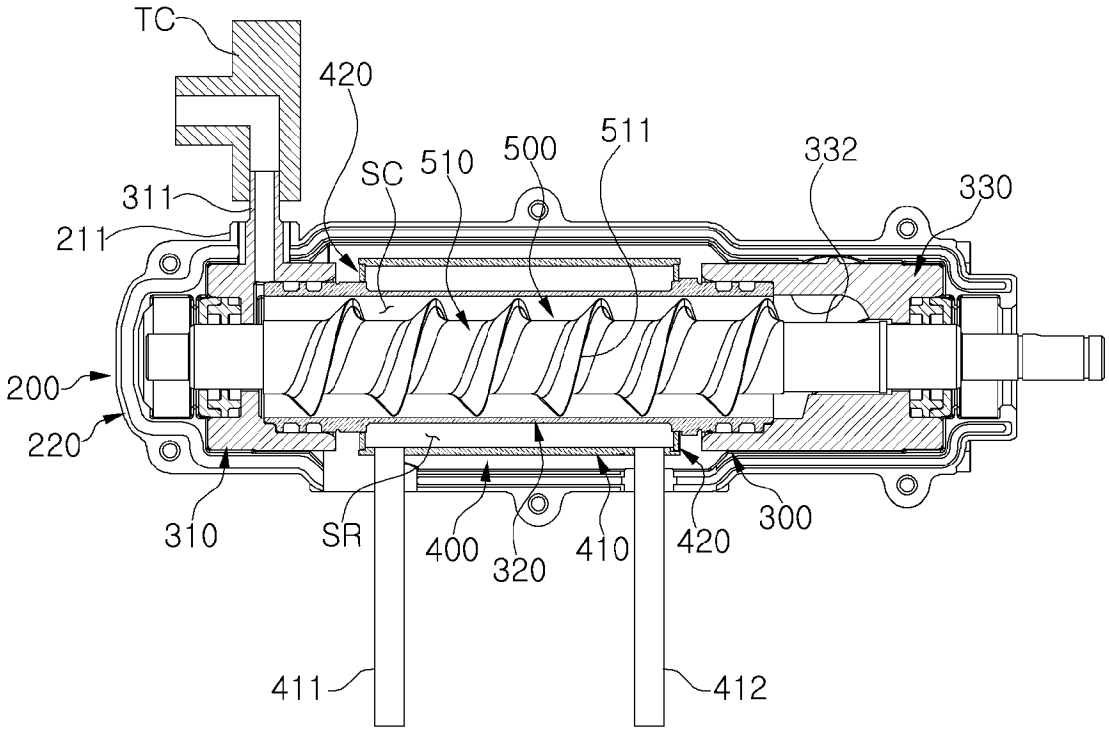
FIG. 5 is a cross-sectional diagram taken along line II-II' in FIG. 1.

FIG. 4 is a cross-sectional diagram taken along line I-I' in FIG. 1. FIG. 5 is a cross-sectional diagram taken along line II-II' in FIG. 1.

Figure 6:
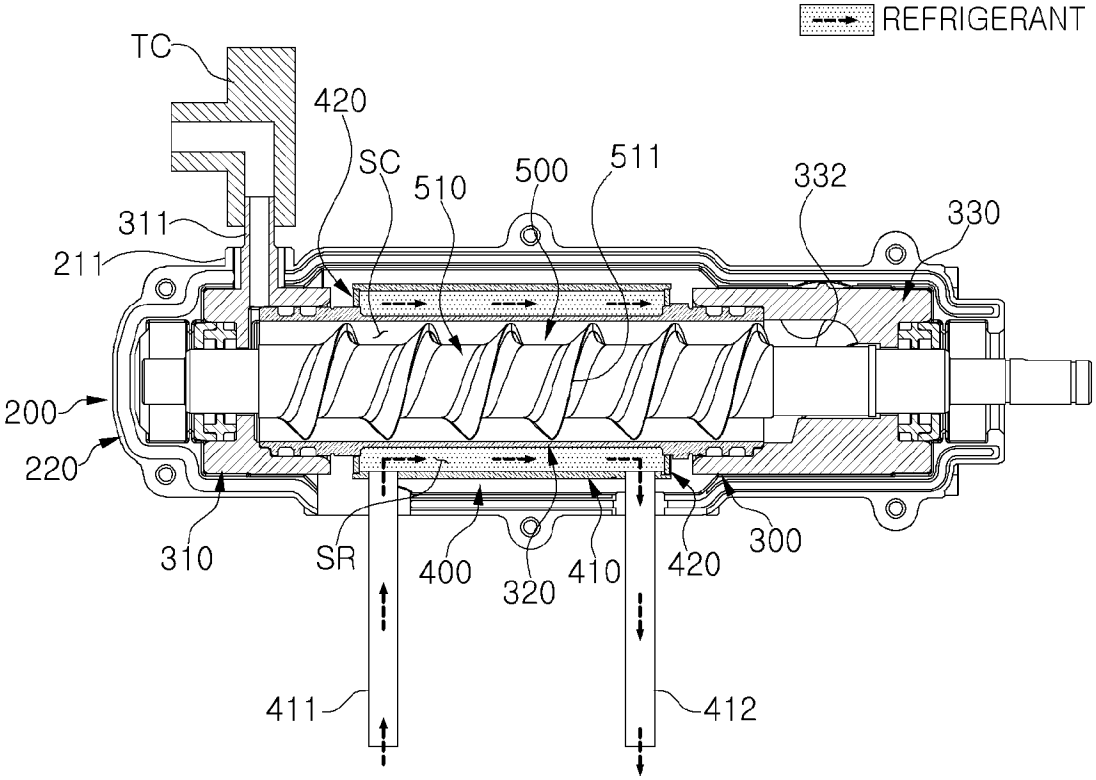
FIGS. 6 to 12 are diagrams illustrating operations of an icemaker according to an exemplary embodiment in the present disclosure.
Figure 7:
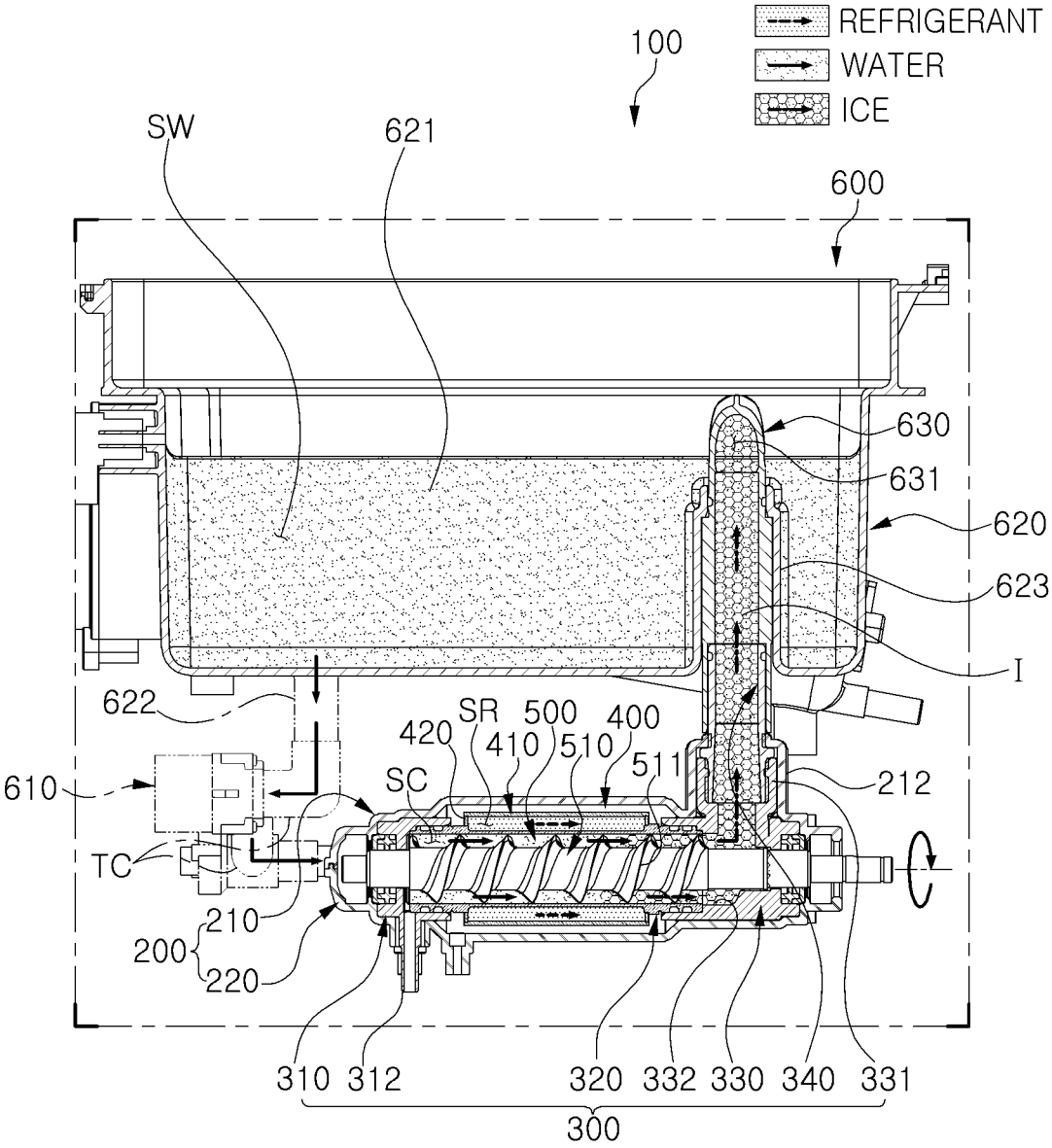
Figure 8:
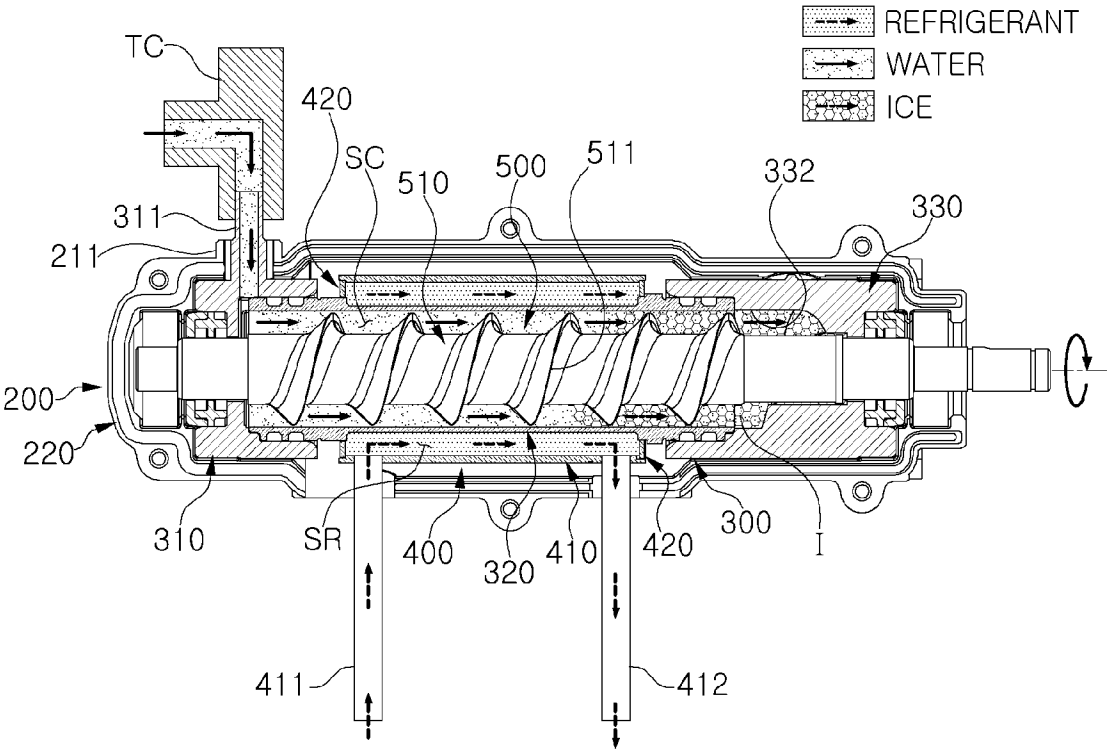
Figure 9:
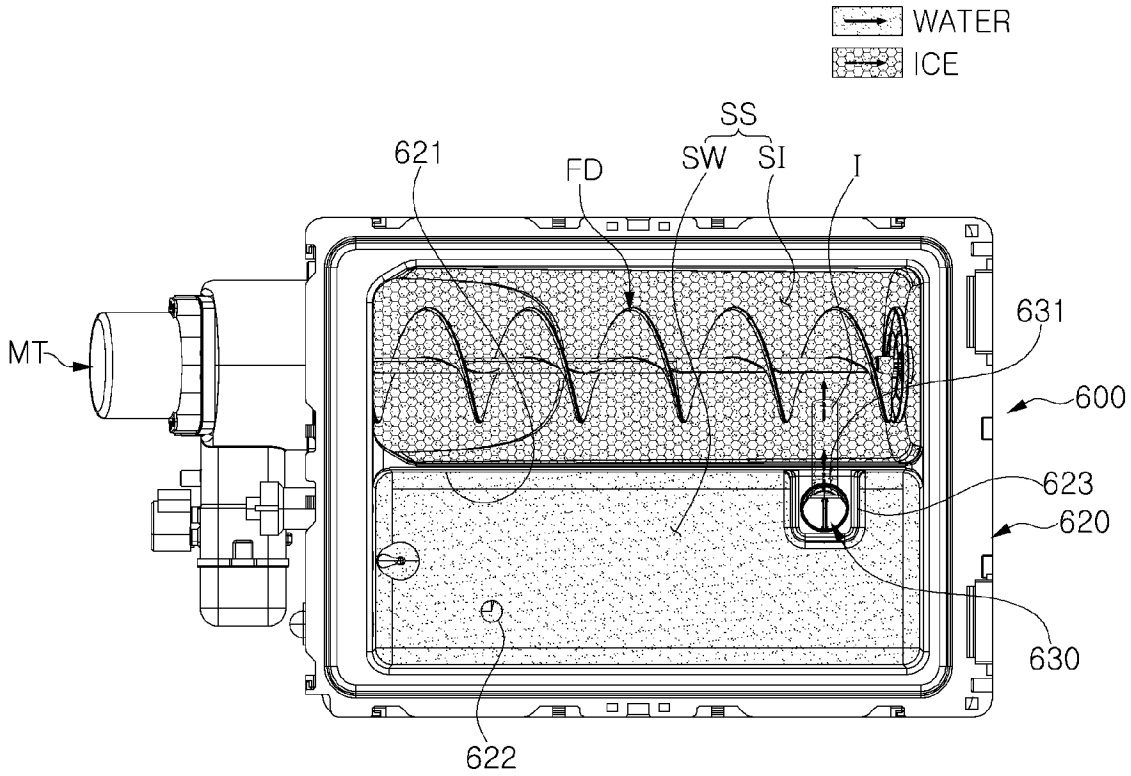
Figure 10:
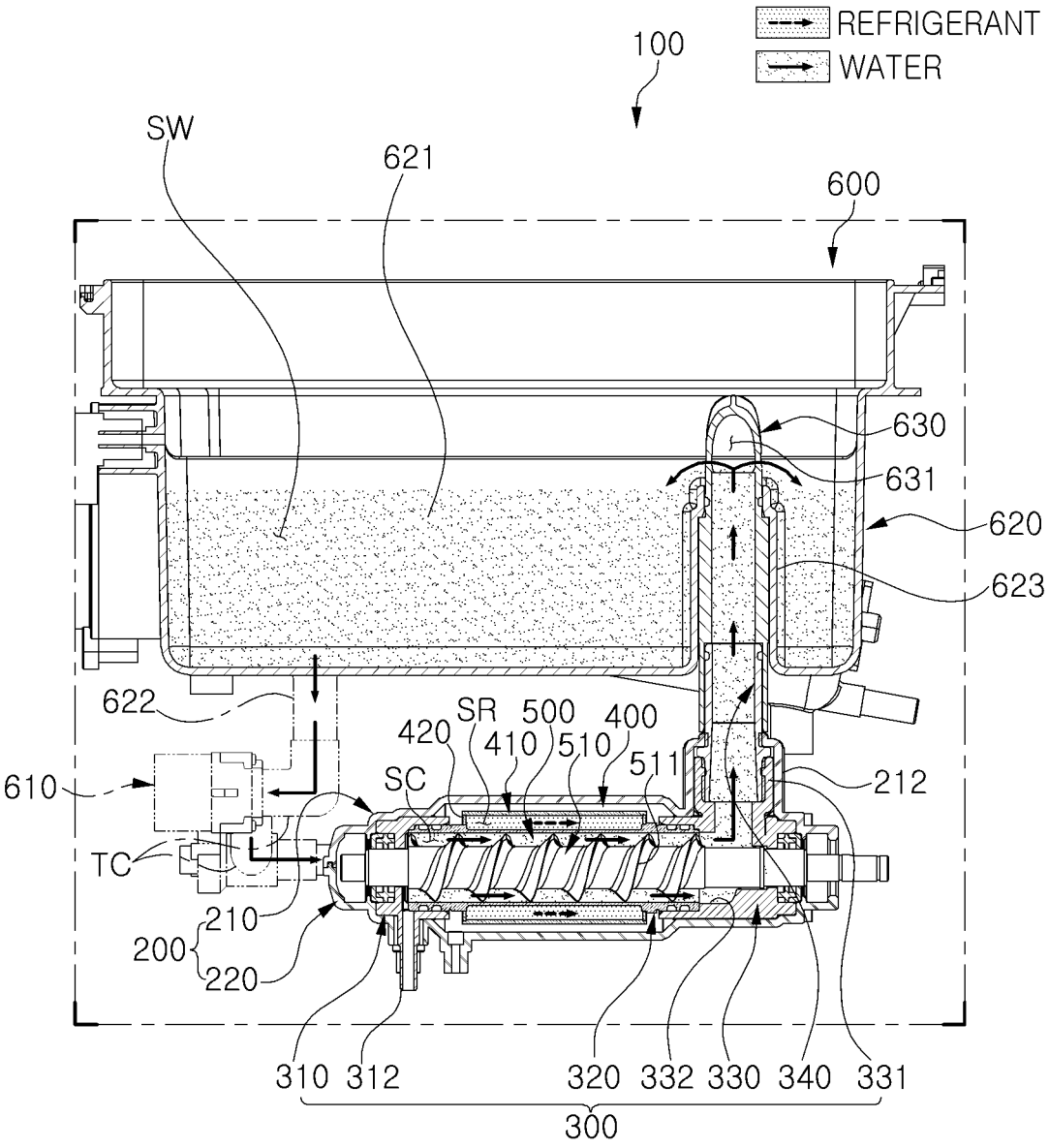
Figure 11:
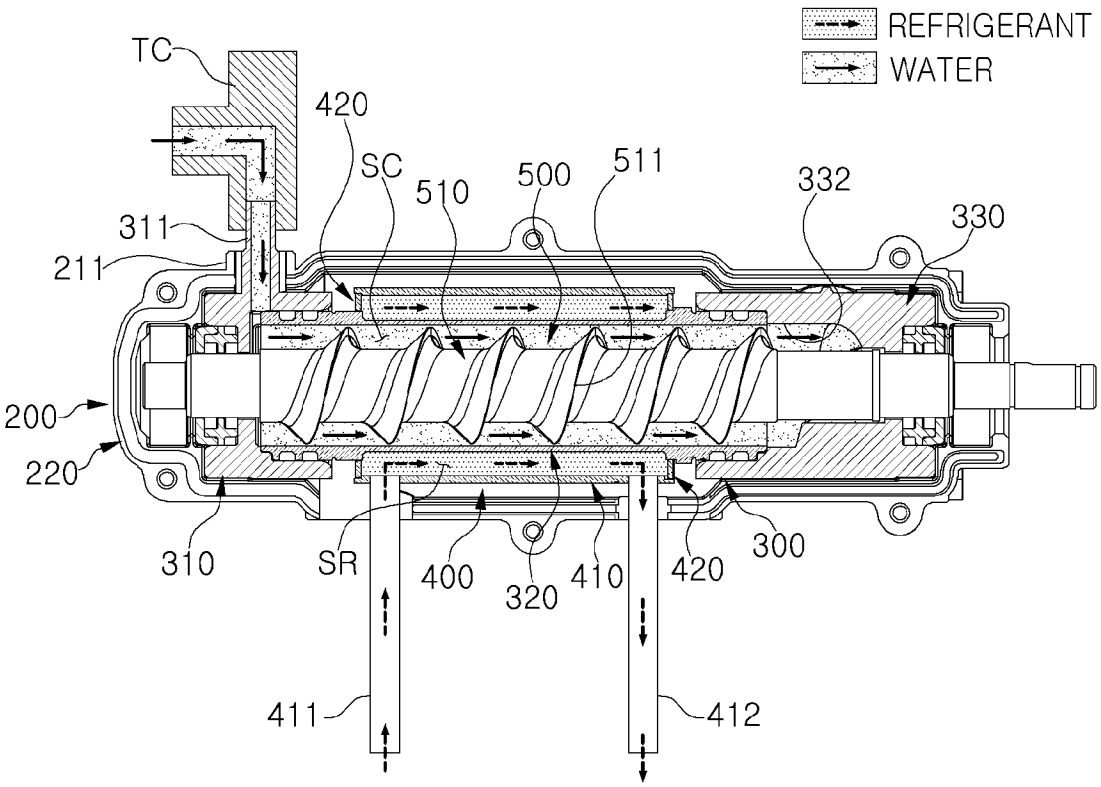
Figure 12:
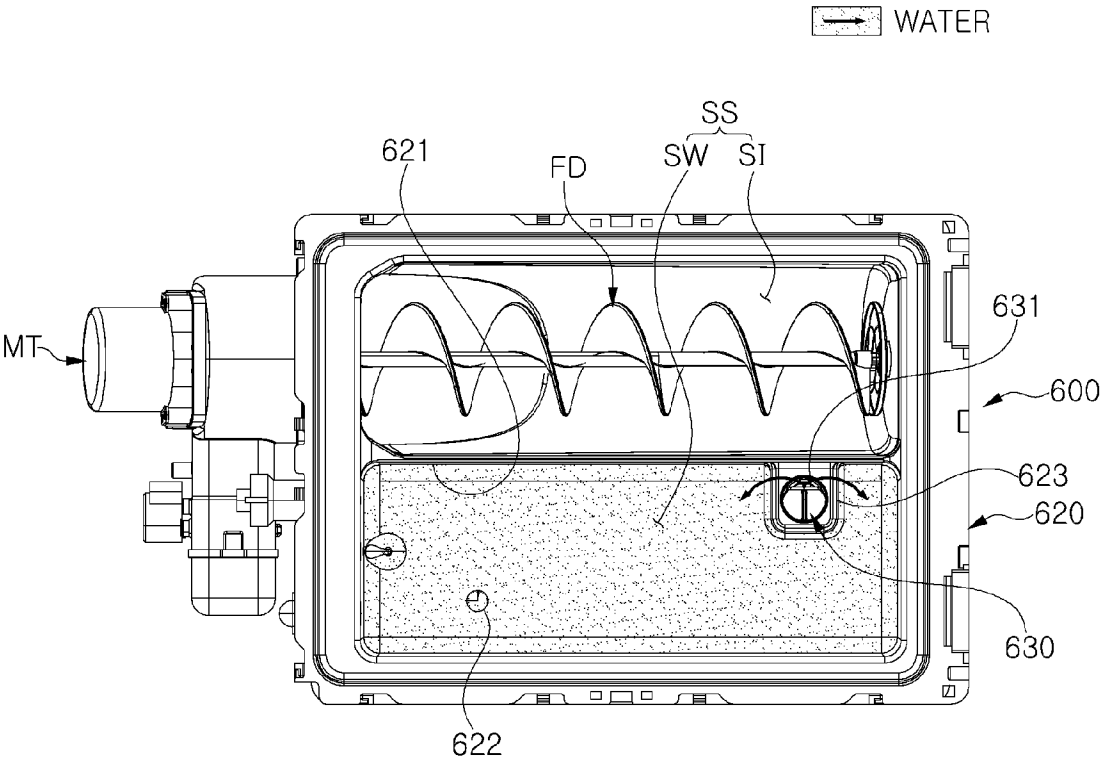

FIGS. 6 to 12 are diagrams illustrating operations of an icemaker according to an exemplary embodiment. FIG. 6 illustrates an example in which a refrigerant flows in a cooling portion of an icemaker, FIGS. 7 to 9 illustrate an example in which an ice making operation is performed in an icemaker, and FIGS. 10 to 12 illustrate an example in which a cold water making operation is performed in an icemaker, according to an exemplary embodiment.

Figure 13:
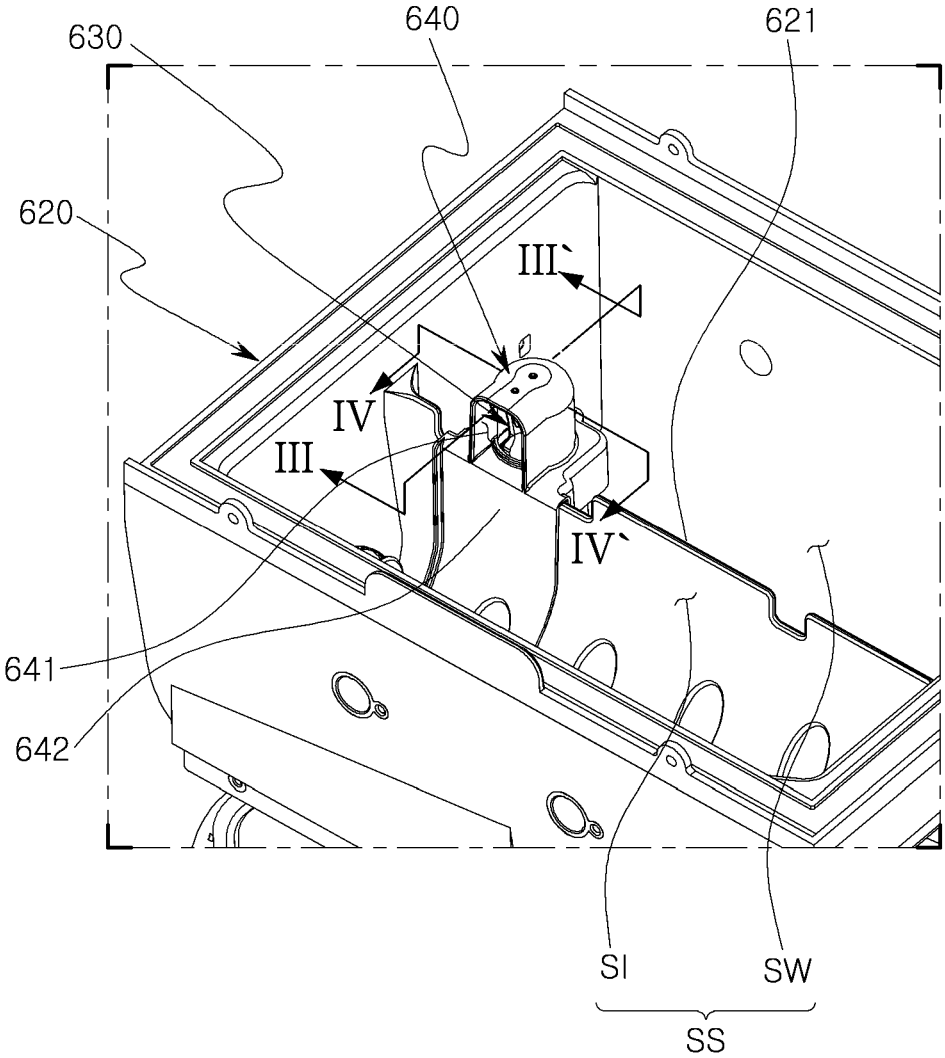
FIG. 13 is a partially enlarged perspective diagram illustrating another example of a supplying and storing portion of an icemaker according to an exemplary embodiment in the present disclosure.
Figure 14:
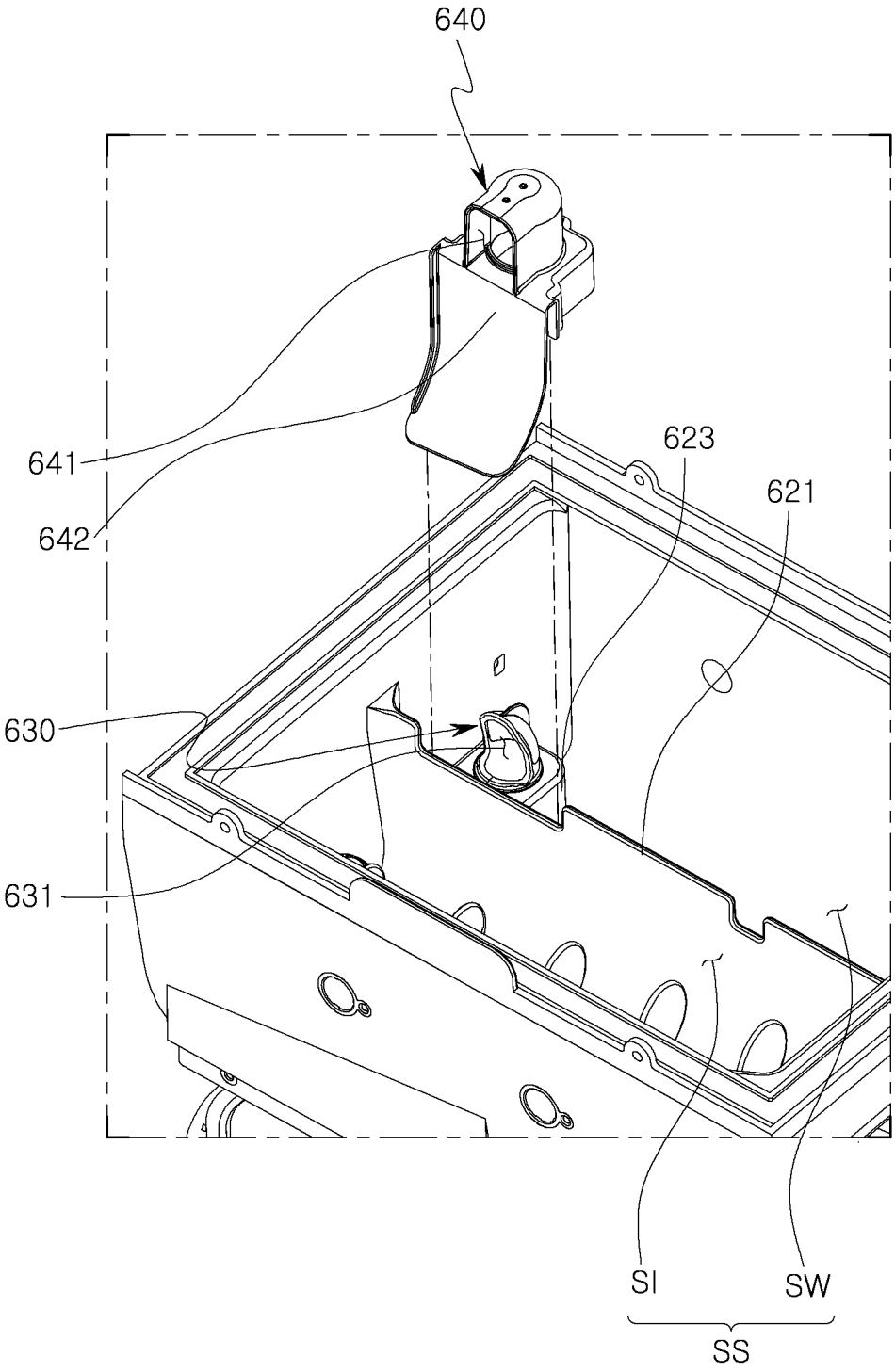
FIG. 14 is a partially enlarged perspective diagram illustrating an example in which a supply guiding member of another example of a supplying and storing portion of an icemaker is separated from a supplying and storing pipe according to an exemplary embodiment in the present disclosure.
Figure 15:
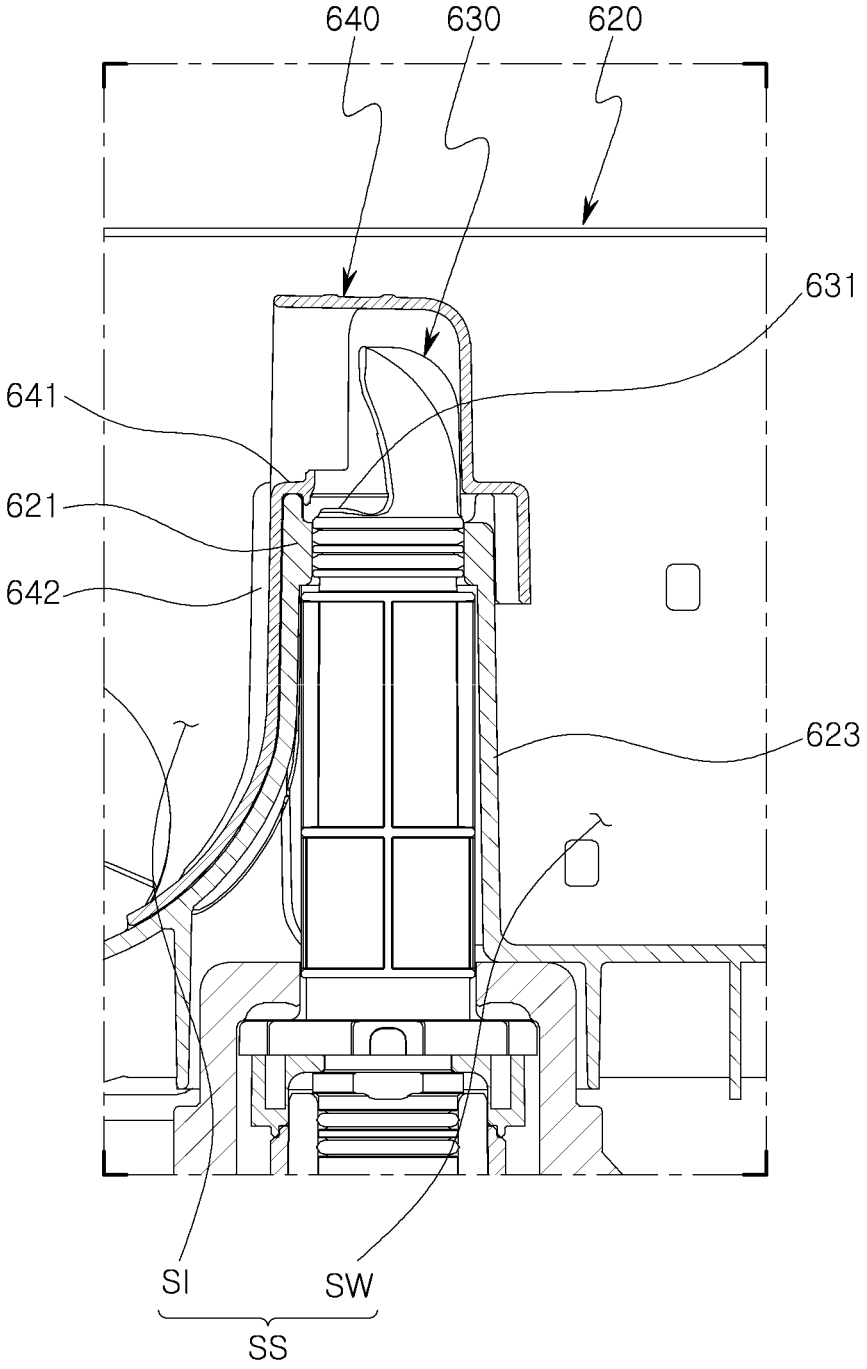
FIG. 15 is an enlarged cross-sectional diagram taken along line III-III' in FIG. 13.
Figure 16:
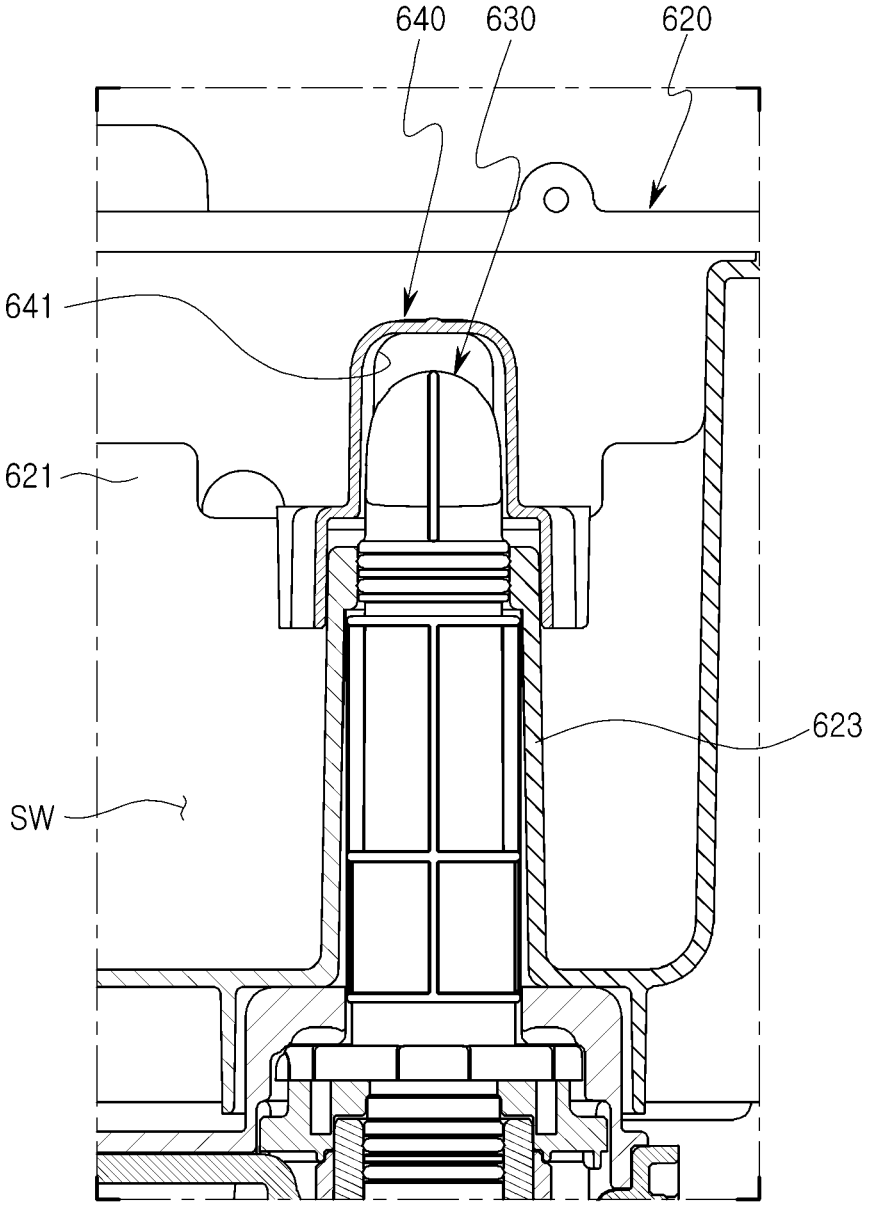
FIG. 16 is an enlarged cross-sectional diagram taken along line IV-IV' in FIG. 13.

FIG. 13 is a partially enlarged perspective diagram illustrating another example of a supplying and storing portion of an icemaker according to an exemplary embodiment. FIG. 14 is a partially enlarged perspective diagram illustrating an example in which a supply guiding member of another example of a supplying and storing portion of an icemaker is separated from a supplying and storing pipe according to an exemplary embodiment. FIG. 15 is an enlarged cross-sectional diagram taken along line III-III' in FIG. 13. FIG. 16 is an enlarged cross-sectional diagram taken along line IV-IV' in FIG. 13.

Figure 17:
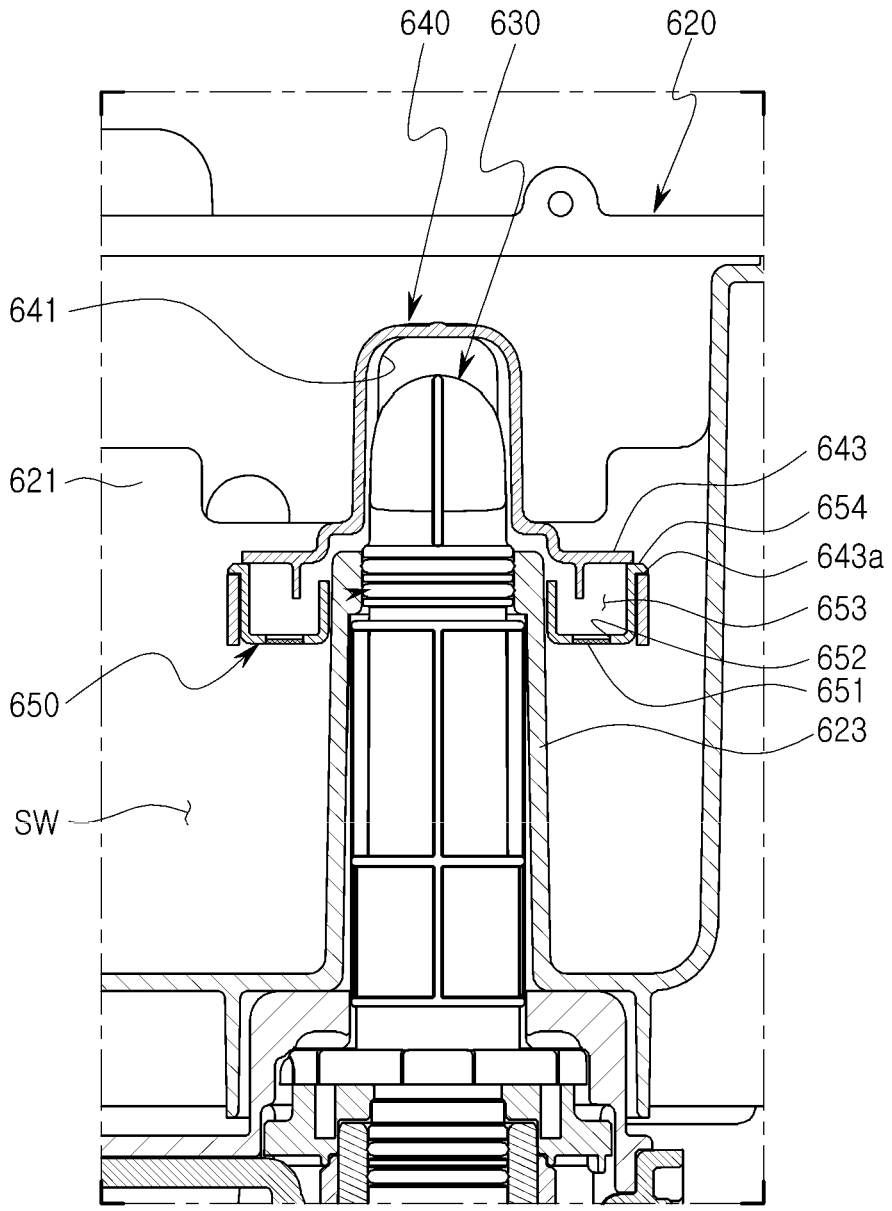
FIG. 17 is a partially enlarged cross-sectional diagram the same as FIG. 16, illustrating another example of a supplying and storing portion of an icemaker according to an exemplary embodiment in the present disclosure.
Figure 18:
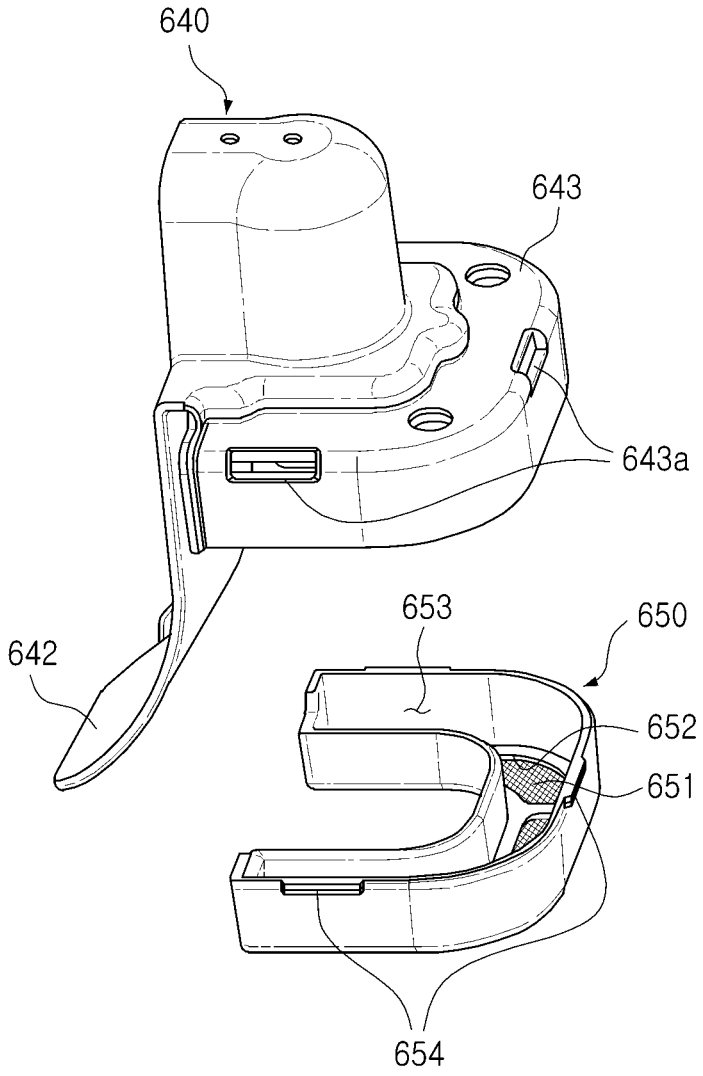
FIG. 18 is a perspective diagram illustrating an example in which a foreign object removing member of another example of a supplying and storing portion of an icemaker is separated from a supply guiding member according to an exemplary embodiment in the present disclosure.

FIG. 17 is a partially enlarged cross-sectional diagram the same as FIG. 16, illustrating another example of a supplying and storing portion of an icemaker according to an exemplary embodiment. FIG. 18 is a perspective diagram illustrating an example in which a foreign object removing member of another example of a supplying and storing portion of an icemaker is separated from a supply guiding member according to an exemplary embodiment.

An icemaker 100 in the exemplary embodiment may include a device body 200, a flow portion 300, a cooling portion 400, a separating and transferring portion 500, and a supplying and storing portion 600.

The device body 200 may include an inflow penetration portion 211 and a discharge penetration portion 212. An inflow opening 311 included in the flow portion 300 may directly or indirectly penetrate through the inflow penetration portion 211. A discharge opening 331 included in the flow portion 300 may directly or indirectly penetrate through the discharge penetration portion 212.

As an example, as illustrated in FIG. 5, the inflow opening 311 of the flow portion 300 may directly penetrate through the inflow penetration portion 211.

An extended discharge member 340 may be connected to the discharge opening 331 of the flow portion 300 as illustrated in FIG. 4. As the extended discharge member 340 of the flow portion 300 penetrates through the discharge penetration portion 212, the discharge opening 331 of the flow portion 300 may indirectly penetrate through the discharge penetration portion 212.

However, the configuration in which the inflow opening 311 and the discharge opening 331 of the flow portion 300 penetrate through the inflow penetration portion 211 and the discharge penetration portion 212 is not limited to any particular example. Any well-known configuration may be used as long as the inflow opening 311 and the discharge opening 331 of the flow portion 300 may directly or indirectly penetrate through the inflow penetration portion 211 and the discharge penetration portion 212.

Shapes and configurations of the inflow penetration portion 211 and the discharge penetration portion 212 are not limited to any particular shapes and configurations. The inflow penetration portion 211 and the discharge penetration portion 212 may have any shapes and configurations as long as the inflow opening 311 and the discharge opening 331 of the flow portion 300 may penetrate through the inflow penetration portion 211 and the discharge penetration portion 212.

The device body 200 may include an upper body 210 including a portion of the inflow penetration portion 211 and the discharge penetration portion 212, and a lower body 220 coupled to the upper body 210 and including the remaining portion of the inflow penetration portion 211. The device body 200 may have an integrated form.

The flow portion 300 may include the inflow opening 311 and the discharge opening 331 directly or indirectly penetrating through the inflow penetration portion 211 and the discharge penetration portion 212 of the device body 200, respectively. Also, the flow portion 300 may include a flow space SC connected to the inflow opening 311 and the discharge opening 331.

For example, water stored in a water storing space SW formed in the supplying and storing portion 600 may flow into the flow space SC through the inflow opening 311 of the flow portion 300 as illustrated in FIGS. 8 and 11.

Also, ice I made in the flow space SC, and separated and transferred by the separating and transferring portion 500 may be discharged through the discharge opening 331 of the flow portion 300 as illustrated in FIG. 7.

Cold water made in the flow space SC may be discharged through the discharge opening 331 of the flow portion 300 as illustrated in FIG. 10.

As illustrated in FIG. 2, the flow portion 300 may include an inflow member 310, a flow member 320, and a discharge member 330.

The inflow member 310 may include the inflow opening 311.

The inflow member 310 may further include a drain port 312 as illustrated in FIGS. 2 and 4. The drain port 312 may include an opening and closing valve (not illustrated). When the opening and closing valve of the drain port 312 is opened, water stored in the flow space SC may be drained externally through the drain port 312.

One side of a screw member 510 included in the separating and transferring portion 500 may be inserted into the inflow member 310, and one side of the screw member 510 may be rotatably provided. To this end, the inflow member 310 may include a bearing (not illustrated), and the like.

The flow member 320 may be connected to the inflow member 310, and the flow space SC may be formed in the flow member 320.

As illustrated in FIG. 2, the flow member 320 may have a cylindrical shape. However, a shape of the flow member 320 is not limited thereto, and the flow member 320 may have any shape as long as the flow member 320 may be connected to the inflow member 310, and the flow space SC may be formed in the flow member 320.

The discharge member 330 may be connected to the flow member 320. The discharge member 330 may include the discharge opening 331.

The other side of the screw member 510 of the separating and transferring portion 500 may penetrate through the discharge member 330, and the other side of the screw member 510 may be rotatably provided. To this end, the discharge member 330 may include a bearing (not illustrated), and the like.

The discharge member 330 may include a connection portion 332 having a spiral shape and connecting the flow space SC and the discharge opening 331, as illustrated in FIG. 4.

The screw member 510 of the separating and transferring portion 500 may be rotatably provided in the flow space SC of the flow member 320, and spiral-shaped channels may be formed by separating and transferring wings 511 formed on the screw member 510.

The spiral-shaped channels in the flow space SC may be naturally connected to the spiral-shaped connection portion 332 of the discharge member 330.

Accordingly, the ice I separated from the flow space SC by the screw member 510 may easily be transferred to the discharge opening 331 and may be discharged externally through the spiral-shaped channels in the flow space SC and the connection portion 332 of the discharge member 330 by the screw member 510, as illustrated in FIGS. 7 and 8.

Also, cold water made in the flow space SC may easily flow into the discharge opening 331 and may be discharged externally through the spiral-shaped channels in the flow space SC and the connection portion 332 of the discharge member 330 as illustrated in FIGS. 10 and 11.

The flow portion 300 may further include the extended discharge member 340.

The extended discharge member 340 may be connected to the discharge opening 331. As a supplying and storing pipe 630 included in the supplying and storing portion 600 is connected to the discharge penetration portion 212 of the device body 200, the extended discharge member 340 may be connected to the supplying and storing pipe 630.

Accordingly, as illustrated in FIG. 7, the ice I discharged from the discharge opening 331 may be supplied to the supplying and storing portion 600, to a supplying and storing member 620 included in the supplying and storing portion 600, for example, through the extended discharge member 340 and the supplying and storing pipe 630.

As illustrated in FIG. 10, the cold water discharged from the discharge opening 331 may flow in the extended discharge member 340 and the supplying and storing pipe 630, and may be supplied to the supplying and storing member 620 of the supplying and storing portion 600.

The cooling portion 400 may allow a refrigerant to flow in at least a portion of the periphery of the flow portion 300. Accordingly, heat may be transferred to a refrigerant from water flowing into the flow space SC through the inflow opening 311 of the flow portion 300 and flowing in the flow space SC. Also, the water flowing in the flow space SC in the flow portion 300 may be cooled by the refrigerant such that the water may be turned into the ice I as illustrated I FIGS. 7 and 8, or may be turned into cold water as illustrated in FIGS. 9 and 10.

The cooling portion 400 may include a refrigerant space forming member 410. The refrigerant space forming member 410 may be configured to surround at least a portion of the flow portion 300, for example, a portion other than both ends of the flow member 320 of the flow portion 300, as illustrated in FIGS. 4 and 5. Accordingly, a refrigerant flowing space SR in which a refrigerant flows may be formed between the refrigerant space forming member 410 and the flow portion 300, for example, between the refrigerant space forming member 410 and the flow member 320 of the flow portion 300.

Accordingly, a heat exchange path between a refrigerant and the water flowing in the flow space SC may be significantly reduced. In other words, a refrigerant may exchange heat with the water flowing in the flow space SC only through the flow member 320 of the flow portion 300 in the exemplary embodiment.

Thus, a cooling efficiency of the water flowing in the flow space SC in the flow portion 300, obtained by a refrigerant, may improve, thereby improving cooling ability.

A refrigerant inflow opening 411 and a refrigerant outflow opening 412 may be connected to the refrigerant space forming member 410. To this end, as illustrated in FIG. 2, the refrigerant space forming member 410 may include an inflow connection hole 410*a* to which the refrigerant inflow opening 411 is connected, and an outflow connection hole 410*b* to which the refrigerant outflow opening 412 is connected. A refrigerant may flow into a refrigerant flowing space SR through the refrigerant inflow opening 411, may flow through the refrigerant flowing space SR, and may flow out through the refrigerant outflow opening 412, as illustrated in FIG. 6.

The cooling portion 400 may further include a closing and covering member 420 covering and closing an opened portion between the refrigerant space forming member 410 and the flow portion 300, between the refrigerant space forming member 410 and the flow member 320 of the flow portion 300, for example, such that the closing and covering member 420 and the refrigerant space forming member 410 may form the refrigerant flowing space SR.

The closing and covering member 420 may have a ring shape as illustrated in FIG. 2. However, a shape of the closing and covering member 420 is not limited to any particular shape. The closing and covering member 420 may have any shape as long as the closing and covering member 420 may cover and close an opened portion between the refrigerant space forming member 410 and the flow portion 300, between the refrigerant space forming member 410 and the flow member 320 of the flow portion 300, for example, such that the closing and covering member 420 and the refrigerant space forming member 410 may form the refrigerant flowing space SR.

The separating and transferring portion 500 may separate the ice I made in the flow space SC in the flow portion 300 from the flow space SC, and may transfer the ice I to the discharge opening 331 of the flow portion 300.

The separating and transferring portion 500 may include the screw member 510. The screw member 510 may be rotatably provided in the flow space SC in the flow portion 300.

As described above, one side of the screw member 510 may be inserted into the inflow member 310 of the flow portion 300 and may be rotatably provided. The other side of the screw member 510 may penetrate through the discharge member 330 of the flow portion 300 and may be rotatably provided. The other side of the screw member 510 penetrating through the discharge member 330 of the flow portion 300 may be connected to a separating and transferring motor (not illustrated) by a gear (not illustrated), a chain (not illustrated), and the like. The screw member 510 may be driven, more specifically, may rotate, by the separating and transferring motor.

The screw member 510 may include the separating and transferring wings 511 each having a spiral shape. By the spiral-shaped separating and transferring wings 511, spiral-shaped channels may be formed in the flow space SC in the flow portion 300.

In the configuration above, when the screw member 510 rotates by the separating and transferring motor, the ice I made on an inner circumferential surface of the flow space SC may be separated by the separating and transferring wings 511 of the screw member 510. The ice I separated from the inner circumferential surface of the flow space SC in the flow portion 300 may be transferred to the discharge opening 331 of the flow portion 300 through the spiral-shaped channels in the flow space SC by the separating and transferring wings 511 of the screw member 510 as illustrated in FIGS. 7 and 8.

The ice I transferred to the discharge opening 331 of the flow portion 300 may be discharged from the discharge opening 331, and may be supplied to the supplying and storing portion 600 through the extended discharge member 340 and the supplying and storing pipe 630, for example.

The supplying and storing portion 600 may be connected to the inflow opening 311 and the discharge opening 331 of the flow portion 300. As illustrated in FIGS. 7, 8, 10, and 11, the supplying and storing portion 600 may supply water to the inflow opening 311 of the flow portion 300, and may be supplied with the ice I or cold water from the discharge opening 331 of the flow portion 300.

The supplying and storing portion 600 may include a pump 610 connected to the inflow opening 311 of the flow portion 300. The pump 610 may be connected to the inflow opening 311 of the flow portion 300 by a plurality of connection pipes TC.

The pump 610 may be connected to a supplying and connecting port 622 provided in the supplying and storing member 620 by the connection pipes TC, for example, such that the pump 610 may be connected to the water storing space SW formed in the supplying and storing member 620, as illustrated in FIG. 1.

Accordingly, when the pump 610 is driven, water stored in the water storing space SW in the supplying and storing member 620 may flow into the inflow opening 311 of the flow portion 300, and may flow in the flow space SC in the flow portion 300, as illustrated in FIGS. 10 and 11.

In this case, as a flow velocity of the water flowing in the flow space SC in the flow portion 300 is relatively high, even when the water flowing in the flow space SC is cooled by the cooling portion 400, the ice I may not be made in the flow space SC, or a relatively small amount of ice I may be made in the flow space SC.

Thus, the water cooled by the cooling portion 400 while flowing in the flow space SC in the flow portion 300 may be turned into cold water and may be discharged through the discharge opening 331 of the flow portion 300 as illustrated in FIG. 11. The water discharged through the discharge opening 331 of the flow portion 300 may be supplied to the supplying and storing portion 600 through the extended discharge member 340 and the supplying and storing pipe 630, for example.

Even when the pump 610 is not driven, if the supplying and storing portion 600 is positioned above the flow portion 300 as illustrated in FIG. 4, the water stored in the water storing space SW in the supplying and storing member 620 of the supplying and storing portion 600 may pass through a channel (not illustrated) formed in the pump 610 by a difference in heights, and may flow into the inflow opening 311 of the flow portion 300 and may flow in the flow space SC, as illustrated in FIGS. 7 and 8.

In this case, as a flow velocity of the water flowing in the flow space SC in the flow portion 300 is relatively low, the water flowing in the flow space SC may be cooled by the cooling portion 400, and the ice I may be made in the flow space SC.

As described above, the ice I made in the flow space SC in the flow portion 300 may be separated from the flow space SC by rotation of the screw member 510 by the separating and transferring motor as described above, and may be transferred to the discharge opening 331 of the flow portion 300 as illustrated in FIG. 7.

The ice I transferred to the discharge opening 331 of the flow portion 300 may be discharged from the discharge opening 331, and may be supplied to the supplying and storing portion 600 through the extended discharge member 340 and the supplying and storing pipe 630, for example.

The supplying and storing portion 600 may further include the supplying and storing member 620. The supplying and storing member 620 may include an ice storing space SI storing the ice I and the water storing space SW storing water.

For example, as illustrated in FIG. 3, a dividing member 621 may be provided in the supplying and storing member 620 such that the dividing member 621 may divide a storage space SS formed in the supplying and storing member 620 into the ice storing space SI and the water storing space SW.

An upper end of the supplying and storing member 620 may be opened. Water in a water supply source (not illustrated) such as a tap water, or a filtering portion and the like, of a water processing device as a water purifier including a purifying filter to filter water may flow through a supply pipe (not illustrated) connected to the water supply source, and may flow into the water storing space SW through the opened upper portion of the supplying and storing member 620 and may be stored in the water storing space SW. However, the configuration in which the water from a water supply source is supplied to the water storing space SW in the supplying and storing member 620 is not limited to any particular example, and any well-known configuration may be used.

The supplying and storing member 620 may include the supplying and connecting port 622 as illustrated in FIGS. 3 and 4. The supplying and connecting port 622 may be connected to the water storing space SW in the supplying and storing member 620. The supplying and connecting port 622 may also be connected to the pump 610 by the connection pipes TC.

Accordingly, the water storing space SW in the supplying and storing member 620 may be connected to the inflow opening 311 of the flow portion 300.

As illustrated in FIGS. 7 and 8, water stored in the water storing space SW in the supplying and storing member 620 may flow into the inflow opening 311 of the flow portion 300 through the supplying and connecting port 622 and the connection pipes TC by driving the pump 610.

Also, as illustrated in FIGS. 10 and 11, water stored in the water storing space SW in the supplying and storing member 620 may pass through a channel of the pump 610 by a difference in height and may flow into the inflow opening 311 of the flow portion 300 through the supplying and connecting port 622 and the connection pipes TC.

The water flowing into the inflow opening 311 of the flow portion 300 may flow into the flow space SC in the flow portion 300.

In the ice storing space SI in the supplying and storing member 620, a transferring member FD may be rotatably provided as illustrated in FIG. 3. The transferring member FD may be connected to a transferring motor MT provided in the supplying and storing member 620, and may rotate by the transferring motor MT. When the transferring member FD rotates by rotation of the transferring motor MT, the ice I stored in the ice storing space SI in the supplying and storing member 620 may be discharged externally through an ice discharge port EI of the supplying and storing member 620, and may be supplied to a user.

The supplying and storing portion 600 may further include the supplying and storing pipe 630. One side of the supplying and storing pipe 630 may be directly or indirectly connected to the discharge opening 331 of the flow portion 300. For example, the supplying and storing pipe 630 may be connected to the extended discharge member 340 connected to the discharge opening 331 of the flow portion 300 by being connected to the discharge penetration portion 212 of the device body 200, and thus, the supplying and storing pipe 630 may be indirectly connected to the discharge opening 331. The supplying and storing pipe 630 may also be directly connected to the discharge opening 331 of the flow portion 300.

The supplying and storing pipe 630 may allow the ice I discharged from the discharge opening 331 to be supplied to the ice storing space SI in the supplying and storing member 620 as illustrated in FIG. 9, or may allow cold water discharged from the discharge opening 331 to be supplied to the water storing space SW in the supplying and storing member 620 as illustrated in FIG. 12.

To this end, the other side of the supplying and storing pipe 630 may penetrate through the supplying and storing member 620 and may be positioned in the water storing space SW in the supplying and storing member 620.

For example, a penetration portion 623 may be formed in the water storing space SW portion in the supplying and storing member 620 as illustrated in FIGS. 3 and 4, and the other side of the supplying and storing pipe 630 may penetrate through the penetration portion 623 of the supplying and storing member 620, and may be disposed in the water storing space SW in the supplying and storing member 620.

Also, a supply hole 631 through which the ice I or cold water is discharged may be disposed on the other end of the supplying and storing pipe 630 towards the ice storing space SI in the supplying and storing member 620.

A lower end of the supply hole 631 may be positioned lower than an upper end of the dividing member 621 of the supplying and storing member 620, and an upper end of the supply hole 631 may be positioned higher than the upper end of the dividing member 621.

Accordingly, the ice I discharged from the discharge opening 331 of the flow portion 300 and transferred to the supply hole 631 through the extended discharge member 340 and the supplying and storing pipe 630 may move over the dividing member 621 of the supplying and storing member 620 and may be supplied to the ice storing space SI, and may be stored in the ice storing space SI.

Also, the cold water discharged from the discharge opening 331 of the flow portion 300 and flowing into the supply hole 631 through the extended discharge member 340 and the supplying and storing pipe 630 may not flow over the dividing member 621 of the supplying and storing member 620, and thus, as illustrated in FIG. 12, the cold water may be supplied to the water storing space SW in the supplying and storing member 620 and may be stored in the water storing space SW.

The cold water stored in the water storing space SW in the supplying and storing member 620 may be discharged externally by a cold water discharge pipe (not illustrated) connected to the water storing space SW, and a cock, a faucet (not illustrated), or the like, connected to the cold water discharge pipe, and may be supplied to a user.

The cold water stored in the water storing space SW in the supplying and storing member 620 may be supplied to the flow space SC in the flow portion 300 through the supplying and connecting port 622, the pump 610, and the inflow opening 311 of the flow portion 300.

When cold water is supplied to the flow space SC in the flow portion 300, the ice I may be easily and swiftly made in the flow space SC. Also, as the cold water circulates between the water storing space SW in the supplying and storing member 620 and the flow space SC in the flow portion 300, cold water having a certain temperature may easily be made, and when a temperature of cold water increases to a certain temperature or higher, the cold water may circulate such that the cold water may have a certain temperature or lower.

The supplying and storing portion 600 may further include a supply guiding member 640 as illustrated in FIG. 13.

The supply guiding member 640 may be connected to the other end of the supplying and storing pipe 630. For example, as illustrated in FIGS. 15 and 16, as the other end of the supplying and storing pipe 630 is inserted into the supply guiding member 640, the supply guiding member 640 may be connected to the other end of the supplying and storing pipe 630. However, the configuration in which the supply guiding member 640 is connected to the other end of the supplying and storing pipe 630 is not limited to any particular example, and any well-known configuration may be used.

The supply guiding member 640 may guide the ice I or cold water discharged from the supply hole 631 formed on the other end of the supplying and storing pipe 630 to be supplied to the ice storing space SI or the water storing space SW in the supplying and storing member 620, respectively.

To this end, an ice guiding hole 641 connected to the supply hole 631 of the supplying and storing pipe 630 may be disposed in the supply guiding member 640 towards the ice storing space SI in the supplying and storing member 620. A lower end of the ice guiding hole 641 of the supply guiding member 640 may be positioned higher than the supply hole 631 of the supplying and storing pipe 630. Also, an extended guiding portion 642 extending to the ice storing space SI in the supplying and storing member 620 from the lower end of the ice guiding hole 641 may be disposed in the supply guiding member 640.

Accordingly, the ice I discharged from the discharge opening 331 of the flow portion 300 and transferred to the supply hole 631 through the extended discharge member 340 and the supplying and storing pipe 630 may be discharged from the supply hole 631 of the supplying and storing pipe 630. The ice I discharged from the supply hole 631 of the supplying and storing pipe 630 may pass through the ice guiding hole 641 of the supply guiding member 640, and may be guided by the extended guiding portion 642 such that the ice I may be supplied to and may be stored in the ice storing space SI in the supplying and storing member 620.

Also, the cold water discharged from the discharge opening 331 of the flow portion 300 and flowing into the supply hole 631 through the extended discharge member 340 and the supplying and storing pipe 630 may not flow over the ice guiding hole 641 of the supply guiding member 640. Accordingly, the cold water discharged from the supply hole 631 of the supplying and storing pipe 630 may be supplied to the water storing space SW in the supplying and storing member 620 through a space between the supply guiding member 640 and the supplying and storing pipe 630, and may be stored in the water storing space SW.

The supplying and storing portion 600 may further include a foreign object removing member 650 as illustrated in FIGS. 17 and 18.

Cold water discharged from the supply hole 631 of the supplying and storing pipe 630 may pass through the foreign object removing member 650. As the cold water passes through the foreign object removing member 650, foreign objects may be removed from the cold water and the cold water may flow into the water storing space SW in the supplying and storing member 620. Accordingly, the cold water in which foreign objects are removed may be stored in the water storing space SW in the supplying and storing member 620, and clean cold water may be provided to a user.

The foreign object removing member 650 may include a mesh member 651. Foreign objects in the cold water may be filtered by the mesh member 651, and may be removed from the cold water. An exemplary embodiment of the mesh member 651 is not limited to any particular example, and any well-known mesh member may be used as long as a mesh member may filter and remove foreign objects included in cold water.

The foreign object removing member 650 may include an installation hole 652 in which the mesh member 651 is provided. The foreign object of removing member 650 may further include a collecting space 653 configured such that one side of the collecting space 653 is opened and the other side thereof is connected to the installation hole 652. Accordingly, the cold water discharged from the supply hole 631 of the supplying and storing pipe 630 may flow into the collecting space 653 through the opened side of the collecting space 653, and foreign objects may be removed from the cold water by the mesh member 651 while the cold water passes through the installation hole 652. The foreign objects removed from the cold water by the mesh member 651 may be collected in the collecting space 653.

The foreign object removing member 650 may be separably connected to the supplying and storing pipe 630 or the supply guiding member 640 connected to the supplying and storing pipe 630. Accordingly, when the collecting space 653 in the foreign object removing member 650 is filled with the foreign objects removed from cold water, the foreign object removing member 650 may be separated from the supplying and storing pipe 630 or the supply guiding member 640. The foreign objects collected in the collecting space 653 in the foreign object removing member 650 may be externally discarded, and the foreign object removing member 650 may be connected to the supplying and storing pipe 630 or the supply guiding member 640 again.

As an example, the supply guiding member 640 may include an extended connection portion 643. The extended connection portion 643 may include a connection separating hole 643*a*, and the foreign object removing member 650 may include a connection separating protrusion 654. Accordingly, the foreign object removing member 650 may be connected to the supply guiding member 640 as the connection separating protrusion 654 of the foreign object removing member 650 is inserted into the connection separating hole 643*a* of the extended connection portion 643 of the supply guiding member 640. Also, as the connection separating protrusion 654 of the foreign object removing member 650 is separated from the connection separating hole 643*a* of the extended connection portion 643 of the supply guiding member 640, the foreign object removing member 650 may be separated from the supply guiding member 640.

However, the configuration in which the foreign object removing member 650 is separably connected to the supplying and storing pipe 630 or the supply guiding member 640 connected to the supplying and storing pipe 630 is not limited to any particular example, and any well-known configuration may be used.

Also, the configuration of the foreign object removing member 650 is not limited to the example above, and any well-known configuration may be used as long as foreign objects are removed from cold water discharged from the supply hole 631 of the supplying and storing pipe 630 while the cold water passes through the foreign object removing member 650, and the cold water flows into the water storing space SW in the supplying and storing member 620.

According to the aforementioned exemplary embodiments, in the icemaker, water flowing in the flow space formed in the flow portion included in the icemaker may be cooled by a refrigerant flowing in at least a portion of the periphery of the flow portion such that ice or cold water may be made. Further, cold water as well as ice may be made in the icemaker, and cooling ability of the icemaker may improve.

The icemaker described above is not limited to the features described in the exemplary embodiments set forth herein, but overall or some of the exemplary embodiments may be selectively combined and configured to implement a variety of modifications.

The invention claimed is:

1. An icemaker, comprising:

a device body including an inflow penetration portion and a discharge penetration portion;

a flow portion including an inflow opening and a discharge opening, directly or indirectly penetrating through the inflow penetration portion and the discharge penetration portion, respectively, and including a flow space connected to the inflow opening and the discharge opening;

a cooling portion allowing a refrigerant to flow in at least a portion of a periphery of the flow portion such that water entering the flow space through the inflow opening and flowing in the flow space is cooled to be turned into ice or cold water;

a separating and transferring portion separating ice made in the flow space from the flow space and transferring the ice to the discharge opening; and a supplying and storing portion connected to the inflow opening and the discharge opening to supply water to the inflow opening and to receive ice or cold water from the discharge opening, wherein the separating and transferring portion includes a screw member rotatably provided in the flow space, the supplying and storing portion includes a pump connected to the inflow opening, the screw member is driven to discharge ice from the discharge opening and to supply ice to the supplying and storing portion, or the pump is driven to discharge cold water from the discharge opening and to supply the cold water to the supplying and storing portion, the supplying and storing portion further includes a supplying and storing member having an ice storing space storing ice and a water storing space storing water, a supplying and storing pipe having one side directly or indirectly connected to the discharge opening, and allowing ice discharged from the discharge opening to be supplied to and stored in the ice storing space or allowing cold water discharged from the discharge opening to be supplied to and stored in the water storing space, the supplying and storing portion includes a dividing member dividing a storage space formed in the supplying and storing member into the ice storing space and the water storing space, the other side of the supplying and storing pipe penetrates through the supplying and storing member and is disposed in the water storing space, the supplying and storing pipe includes a supply hole formed on the other end of the supplying and storing pipe, the supply hole through which ice or cold water is discharged and which is formed towards the ice storing space, and a lower end of the supply hole is positioned lower than an upper end of the dividing member, and an upper end of the supply hole is positioned higher than the upper end of the dividing member.

2. The icemaker of claim 1, wherein the supplying and storing portion includes a supplying and connecting port connected to the water storing space and the pump.

3. The icemaker of claim 1, wherein the flow portion comprises:

an inflow member including the inflow opening;

a flow member connected to the inflow member and having the flow space; and a discharge member connected to the flow member and including the discharge opening.

4. The icemaker of claim 3, wherein the flow portion further includes an extended discharge member connected to the discharge opening, and wherein the discharge penetration portion is connected to the supplying and storing pipe included in the supplying and storing portion and connected to the extended discharge member.

5. The icemaker of claim 1, wherein the cooling portion includes a refrigerant space forming member provided to surround at least a portion of the flow portion such that a refrigerant flowing space in which a refrigerant flows is formed between the cooling portion and the flow portion, and a refrigerant inflow opening and a refrigerant outflow opening are connected to the refrigerant space forming member.

6. An icemaker, comprising:

a device body including an inflow penetration portion and a discharge penetration portion;

a flow portion including an inflow opening and a discharge opening, directly or indirectly penetrating through the inflow penetration portion and the discharge penetration portion, respectively, and including a flow space connected to the inflow opening and the discharge opening;

a cooling portion allowing a refrigerant to flow in at least a portion of a periphery of the flow portion such that water entering the flow space through the inflow opening and flowing in the flow space is cooled to be turned into ice or cold water;

a separating and transferring portion separating ice made in the flow space from the flow space and transferring the ice to the discharge opening; and a supplying and storing portion connected to the inflow opening and the discharge opening to supply water to the inflow opening and to receive ice or cold water from the discharge opening, wherein the separating and transferring portion includes a screw member rotatably provided in the flow space, the supplying and storing portion includes a pump connected to the inflow opening, the screw member is driven to discharge ice from the discharge opening and to supply ice to the supplying and storing portion, or the pump is driven to discharge cold water from the discharge opening and to supply the cold water to the supplying and storing portion, the supplying and storing portion further includes a supplying and storing member having an ice storing space storing ice and a water storing space storing water, a supplying and storing pipe having one side directly or indirectly connected to the discharge opening, and allowing ice discharged from the discharge opening to be supplied to and stored in the ice storing space or allowing cold water discharged from the discharge opening to be supplied to and stored in the water storing space, the other side of the supplying and storing pipe penetrates through the supplying and storing member and is disposed in the water storing space, the supplying and storing pipe has a supply hole on the other end of the supplying and storing pipe, the supply hole through which ice or cold water is discharged and which is formed towards the ice storing space, and the supplying and storing pipe further includes a supply guiding member connected to the other end of the supplying and storing pipe and guiding ice or cold water discharged from the supply hole to be supplied to the ice storing space or the water storing space, respectively.

7. The icemaker of claim 6, wherein the supply guiding member includes an ice guiding hole connected to the supply hole and formed towards the ice storing space, and wherein a lower end of the ice guiding hole is positioned higher than a lower end of the supply hole.

8. The icemaker of claim 7, wherein the supply guiding member includes an extended guiding portion extending from a lower end of the ice guiding hole to the ice storing space and guiding ice discharged from the ice guiding hole to be supplied to the ice storing space.

9. The icemaker of claim 6, wherein the supplying and storing portion further includes a foreign object removing member through which foreign objects are removed from cold water as water passes through the foreign object removing member, and the cold water flows into the water storing space.

10. The icemaker of claim 9, wherein the foreign object removing member includes a mesh member filtering foreign objects included in cold water.

11. The icemaker of claim 10, wherein the foreign object removing member is separably connected to the supplying and storing pipe or the supply guiding member connected to the supplying and storing pipe.

* * * * *